United States Patent [19]

Simeoni

[11] 4,264,298

[45] Apr. 28, 1981

[54] HOTPLATE-TYPE GAS BURNER

[76] Inventor: Giuseppe Simeoni, Monte Riondo 3, Santa Maria di Negrar, Italy

[21] Appl. No.: 877,349

[22] Filed: Feb. 13, 1978

[30] Foreign Application Priority Data

Feb. 17, 1977 [IT] Italy ..... 67348 A/77
Jan. 30, 1978 [IT] Italy ..... 19763 A/78

[51] Int. Cl.[3] ..... F23D 13/12; F02M 39/00; F24C 3/00

[52] U.S. Cl. ..... 431/347; 239/553.3; 126/39 J

[58] Field of Search ..... 126/39 J, 39 K, 39 H; 431/347; 239/559, 553.3, 520

[56] References Cited

U.S. PATENT DOCUMENTS

| | | | |
|---|---|---|---|
| 103,222 | 5/1970 | Meiggs | 239/553.3 |
| 1,598,996 | 9/1926 | Wheelock | 239/559 |
| 2,499,707 | 3/1950 | Warren | 126/39.11 |
| 2,847,988 | 8/1958 | Hess | 126/39 H |
| 2,870,828 | 1/1959 | Hess | 126/39 H |
| 2,870,829 | 1/1959 | Williams | 126/39 H |
| 3,754,853 | 8/1973 | Braucksiek et al. | 431/347 |
| 3,799,142 | 3/1974 | Jensen | 126/39 J |

*Primary Examiner*—Samuel Scott
*Assistant Examiner*—Wesley S. Ratliff, Jr.
*Attorney, Agent, or Firm*—Michael J. Striker

[57] ABSTRACT

A gas burner for cookers the essential feature of which is the enlargement of the body of the burner to form a flat plate equivalent to a real hotplate the inside of which is heated by the flame in such a way that the flame heats the plate by conduction, and further, the heat reaches this hotplate from the central area of the flame and from the point where combustion originates.

9 Claims, 3 Drawing Figures

HOTPLATE-TYPE GAS BURNER

Figure 1:
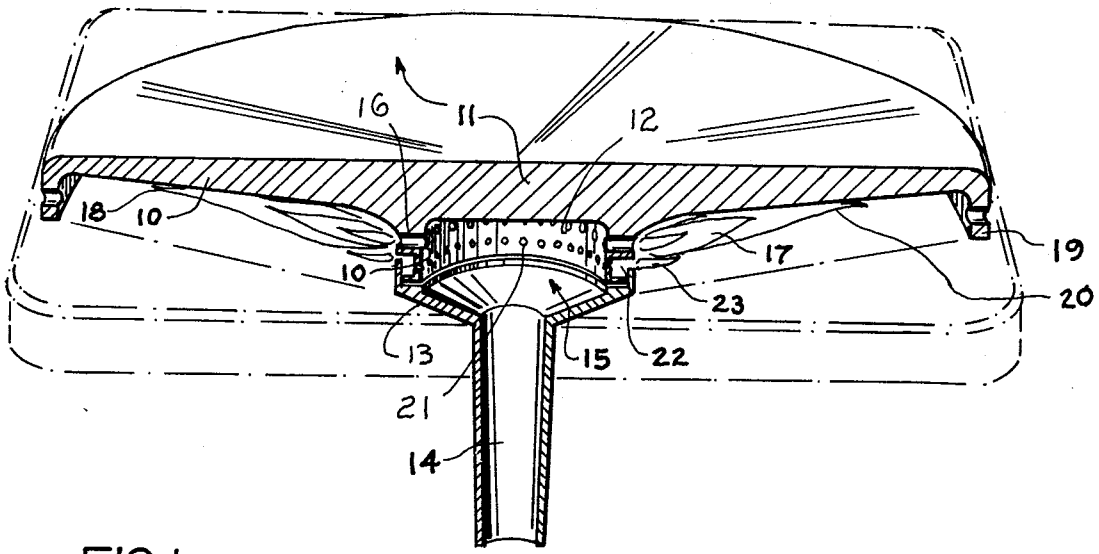

In the case of the ordinary burner for gas cookers, the pans, or metal plates if used, are placed above the burner and receive heat from the tips of the flame thus remaining at some distance from the central zone where combustion takes place.

As the body of the burner is not adequately in contact, either structurally or in any other way, with the cooking pan or with an intermediate metal plate if used, the heat from the central zone where combustion originates becomes to a considerable extent lost in the surrounding atmosphere and thus little used.

The above invention exploits not only the heat from the tip of the flame but also that from the hottest combustion point, thus greatly increasing the thermal yield as will be explained below.

This invention envisages a burner the body of which takes the form of a cooking plate or, expressing it differently but without altering the concept, a burner is formed within the cooking plate.

A particular feature consists in the fact that the body of the burner, comprising the gas, or air-gas mixture, chamber, from which the flame orignates, is extended to form a kind of flat head placed above the circular flame, this head actually being equivalent to a hotplate.

The actual burner therefore appears as a "neck" in one with the plate; the flame issues from above the neck and directly heats the underneath of the plate.

Around the edge of this hotplate there is a raised edge projecting inwards so that a kind of combustion chamber, enclosing the full length of the flame, is formed between the projecting edge, the inside of the plate and the neck.

The foregoing description shows that the external surface of the hotplate receives heat from the hottest combustion area of the actual burner by conduction, heat direct from the flames touching the underside of the plate, and heat collected inside the combustion chamber.

Even if, for practical reasons, this "cooking body" which is simultaneously a hotplate and a burner, is constructed in two or three pieces, the fit, contact surfaces and heat transmissions is such as to maintain the amount of heat, transmitted by conduction to the hotplate, practically unaltered.

The shape given to the hotplate may vary as desired, and may be circular, rectangular or many-sided, while the gas may issue either from a central nozzle, as in the case of the "neck" described above, or from two or more distributors suitably placed barycentrically to the hotplate, and the same applies to the flame issuing from a single nozzle or from more than one.

On its inside, at the point where the flame originates, the plate is arc-shaped so as to convey the flame and the heat waves radially and cause them to reach the whole surface area of the plate.

One execution of the invention envisages application to the lower part of the hotplate of an insulating screen which starts from the bottom of the downward and inwardly projecting edge, enclosing the above-mentioned combustion chamber except for a circular air intake ring around the "neck" of the burner-hotplate.

The attached sketches further illustrate the invention and show two types of execution.

FIG. 1 is a partially cut perspective view.

The body (10) appears as a flat top (11) like an ordinary hotplate the lower part of which consists of the "neck" (12) which, resting in the cup-shaped end (13) of the central, hollow column (14), forms a real burner.

The gas flows through the central column, the lower end of which is shaped to fit into an ordinary nozzle (not shown) connected to the gas main, and enters the chamber (15) while from the apertures placed ringwise (16) the flame (17) touches the lower surface (18) of the plate (11).

The perimeter edge (19) encloses a kind of combustion chamber (20) within which the full length of the flame is contained. The apertures (21) open onto the pre-combustion chamber (22) which creates the stabilizing flame (23).

Figure 2:
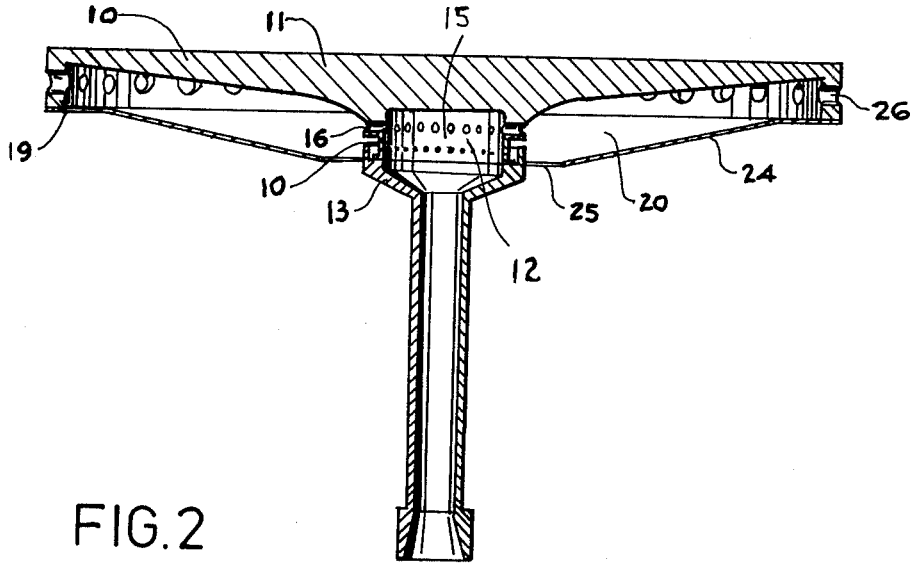
Figure 3:
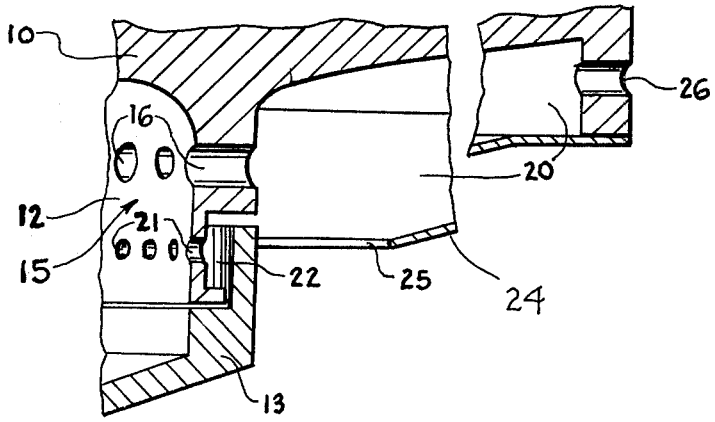

FIG. 2 a vertical section through the middle, and FIG. 3 a detail of FIG. 2, show the burner-hotplate with the same numbering for common or similar parts as that given to FIG. 1.

The insulating shield (24) underneath the plate is joined to the perimeter edge (19) and has ring-shaped air intakes (25). The presence of this shield further reduces dispersion of heat into the room.

The apertures (26) cut into the perimeter edge allow burnt gas to escape and act as a flue.

As the description clearly explains, being structurally a part of the whole, the "body" (10) acts simultaneously as a hotplate and as a burner transmitting heat, by conduction, from the hottest parts of the burner and from the hottest parts of combustion to the hotplate and from there to the pans, or whatever stands on top of it, reducing to a minimum the dispersion of heat into the surrounding air and thus considerably increasing thermal yield.

As executional forms of the invention are here described merely as examples, without thereby limiting it to these, a request for industrial exclusivity must include all equivalent applications of the concept described, and all equivalent products created and/or in operation according to one or more of the characteristics indicated in the following claims.

I claim:

1. A heating device, comprising a plate-shaped wall having an inside surface and an outside surface so that an article to be heated can be supported on said outside surface and said plate-shaped wall can serve as a hotplate, said inside surface of said plate-shaped wall having a central portion; a ring-shaped wall of one-piece with said plate-shaped wall, said ring-shaped wall extending transversely from said inner surface of said plate-shaped wall in the region of said central portion so as to bound a central space communicable with a source of combustible material and being provided with a plurality of passages through which flame resulting from combustion of the combustible material can leave said central space so that said ring-shaped wall forms a burner which is of one piece with said hotplate and thereby the heat is transmitted to said hotplate not only from the tips of the flame but also from the point wherein the flame leaves said passages; and a bottom wall bounding said central space from below and having an inlet operative to receive therethrough said combustible material.

2. A heating device as defined in claim 1, wherein said outside supporting surface has a flat cross-section.

3. A heating device as defined in claim 1, wherein said passages are circumferentially spaced from each other and located adjacently to the inside surface of said plate-shaped wall.

4. A heating device as defined in claim 3; and further comprising a further wall closing said combustion chamber, thereby preventing loss of heat therefrom.

5. A heating device as defined in claim 1, wherein said plate-shaped wall has a peripheral wall portion extending transversely to the remainder portion of the same and being of one piece with said remainder portion, said peripheral portion together with said remainder portion of said plate-shaped wall forming a combustion chamber communicating with said central space through said passages.

6. A heating device, comprising a plate-shaped wall having an inside surface and an outside surface so that an article to be heated can be supported on said outside surface and said plate-shaped wall can serve as a hotplate, said inside surface of said plate-shaped wall having a central portion, said plate shaped wall having a peripheral wall portion extending transversely to the remainder portion of the same and being of one piece with said remainder portion, said peripheral portion together with said remainder portion of said plate-shaped wall forming a combustion chamber; a ring-shaped wall of one-piece with said plate-shaped wall, said ring-shaped wall extending transversely from said inner surface of said plate-shaped wall in the region of said central portion so as to bound a central space communicable with a source of combustible material and being provided with a plurality of passages which communicate said central space with said combustion chamber and through which flame resulting from combustion of the combustible material can leave said central space so that said ring-shaped wall forms a burner which is of one piece with said hotplate and thereby the heat is transmitted to said hotplate not only from the tips of the flame but also from the point wherein the flame leaves said passages; and outlet means for evacuating gases from said combustion chamber.

7. A heating device as defined in claim 6, wherein said outlet means comprises a plurality of through-going openings provided in said peripheral wall portion, each of said openings having a first end open into said combustion chamber and a second end open into the exterior of the latter.

8. A heating device, comprising a plate-shaped wall having an inside surface and an outside surface so that an article to be heated can be supported on said outside surface and said plate-shaped wall can serve as a hotplate, said inside surface of said plate-shaped wall having a central portion, said plate-shaped wall having a peripheral wall portion extending transversely to the remainder portion of the same and being of one piece with said remainder portion, said peripheral portion together with said remainder portion of said plate-shaped wall forming a combustion chamber; a ring-shaped wall of one-piece with said plate-shaped wall, said ring-shaped wall extending transversely from said inner surface of said plate-shaped wall in the region of said central portion so as to bound a central space communicable with a source of combustible material and being provided with a plurality of passages which communicate said central space with said combustion chamber and through which flame resulting from combustion of the combustible material can leave said central space so that said ring-shaped wall forms a burner which is of one piece with said hotplate and thereby the heat is transmitted to said hotplate not only from the tips of the flame but also from the point wherein the flame leaves said passages, said passages being circumferentially spaced from each other and located adjacently to the inside surface of said plate-shaped wall; a further wall closing said combustion chamber thereby preventing loss of heat therefrom; and a further inlet operative for permitting air from exterior of said combustion chamber to enter the latter.

9. A heating device as defined in claim 8, wherein said further inlet is provided in said further wall.

* * * * *